US006223409B1

(12) United States Patent
Schruff

(10) Patent No.: US 6,223,409 B1
(45) **Date of Patent: *May 1, 2001**

(54) RIVET SETTING TOOL

(76) Inventor: Herbert Schruff, Schillerstrabe 20, 65375, Oestrich-Winkel (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/456,969

(22) Filed: Dec. 7, 1999

Related U.S. Application Data

(62) Division of application No. 09/211,520, filed on Dec. 14, 1998.

(30) Foreign Application Priority Data

Dec. 12, 1997 (EP) ..... 97121896

(51) Int. Cl.[7] ..... B21J 15/34; B21D 31/00

(52) U.S. Cl. ..... 29/243.523; 29/243.525; 72/391.4

(58) Field of Search ..... 72/391.2, 391.4; 29/243.523, 243.525, 243.527

(56) References Cited

U.S. PATENT DOCUMENTS

| | | | | |
|---|---|---|---|---|
| 4,088,003 | * | 5/1978 | Schwab | 72/391.4 |
| 4,454,746 | * | 6/1984 | Schwab | 72/391.4 |
| 4,546,637 | * | 10/1985 | Elias | 72/453 |
| 4,612,793 | * | 9/1986 | Klein | 72/114 |
| 5,050,420 | * | 9/1991 | Liu | 72/391.4 |
| 5,575,051 | * | 11/1996 | Moore | 29/243.523 |
| 6,029,332 | * | 2/2000 | Schruff | 29/243.527 |

FOREIGN PATENT DOCUMENTS

| | | |
|---|---|---|
| 27 39 166 A1 | 8/1979 | (DE) . |
| 37 01 883 A1 | 4/1988 | (DE) . |
| 94 08 203 U | 8/1994 | (DE) . |
| 0 159 255 A1 | 10/1985 | (EP) . |
| 0 445 084 A2 | 4/1991 | (EP) . |
| 77 18612 | 6/1977 | (FR) . |
| 2 724 856 | 9/1994 | (FR) . |
| 76 06990 | 11/1997 | (FR) . |
| 2 130 514 | 6/1984 | (GB) . |
| 2 172 233 | 9/1986 | (GB) . |

* cited by examiner

*Primary Examiner*—David Jones
(74) *Attorney, Agent, or Firm*—Reising, Ethington, Barnes, Kisselle, Learman & McCulloch, PC

(57) ABSTRACT

A rivet setting tool provided with a threaded bolt or drift for engaging a nut of the rivet. The rivet has a thin walled sleeve portion which is to be deformed during setting of the rivet and forms a flange. The rivet setting tool is driven with decreasing force during the working stroke of the rivet setting tool. In a first embodiment, a toggle lever arrangement having a pair of hand levers and a pair of linking levers is used to produce a decreasing force during the working stroke. In a second embodiment, a pneumatic cylinder cooperates with spring means in order to produce a force during the working stroke which is decreasing.

1 Claim, 6 Drawing Sheets

RIVET SETTING TOOL

REFERENCE TO CO-PENDING APPLICATION

This application is a division of co-pending application Ser. No. 09/211,520, filed Dec. 14, 1998.

FIELD OF THE INVENTION

The present invention relates generally to a rivet setting tool and particularly to a blind-rivet setting tool showing a decreasing operating force.

BACKGROUND OF THE INVENTION

A blind-rivet is a work piece having a head, a thin walled sleeve portion and a nut and is to be inserted into an opening in a wall or sheet. Fixing of the blind-rivet is by deforming the sleeve portion to a bulge so that the wall or sheet is clamped between head and bulge or flange of the rivet. For performing this rivet setting operation, a screw-threaded bolt or drift is provided at the end of the rivet setting tool which is screwed into the nut so as to engage the same and pull the nut in the direction of the wall or sheet. When doing so, the sleeve portion of the rivet is deformed to make the bulge which takes the shape of a flange. When this has occurred, the danger of damaging the internal threads of the nut will arise by the persisting force of the rivet setting tool. On the other hand, much force is required to initiate bulging of the sleeve portion of the rivet.

SUMMARY OF THE INVENTION

It is an objective of the present invention to provide a rivet setting tool which makes it possible to set rivets without the danger of damaging the nut of the rivet.

It is a further objective of the invention to provide a rivet setting tool which is very simple in construction and which can be produced economically.

Another objective of the invention is to provide a rivet setting tool which developes a decreasing force in riveting.

It is also an objective of the invention to provide a rivet setting tool which stores power for being delivered at the beginning of the working stroke of the tool.

The rivet setting tool of invention comprises a screw-threaded bolt or drift connected to a support block, and a housing member carrying an anvil. A driving apparatus is provided to pull the screw-threaded bolt or drift relative to the anvil. In a preferred embodiment of the invention, the driving apparatus includes a toggle lever arrangement comprising a pair of hand levers and a pair of linking levers. The toggle lever arrangement is such that the force transmission ratio at the beginning of the working stroke, i.e. the relative movement between bolt or drift and anvil, has a high value, whereas at the end of such a movement or stroke has a lower value such that enough force is developed for deforming the thin walled sleeve of the rivet, yet the danger is avoided of damaging the thread of the nut at the end of the working stroke.

In another embodiment of the invention, a pneumatic-hydraulic drive apparatus is provided which includes an energy store to be loaded by the pneumatic-hydraulic drive apparatus. The arrangement is such that the force at the beginning of the working stroke is highest and decreases to the end of the working stroke.

Other objectives, features and advantages of the invention will be apparant from the following detailed description taking in connection with the accompanying drawings.

DETAILED DESCRIPTION OF THE PREFERRED EMBODIMENTS

Figure 1:
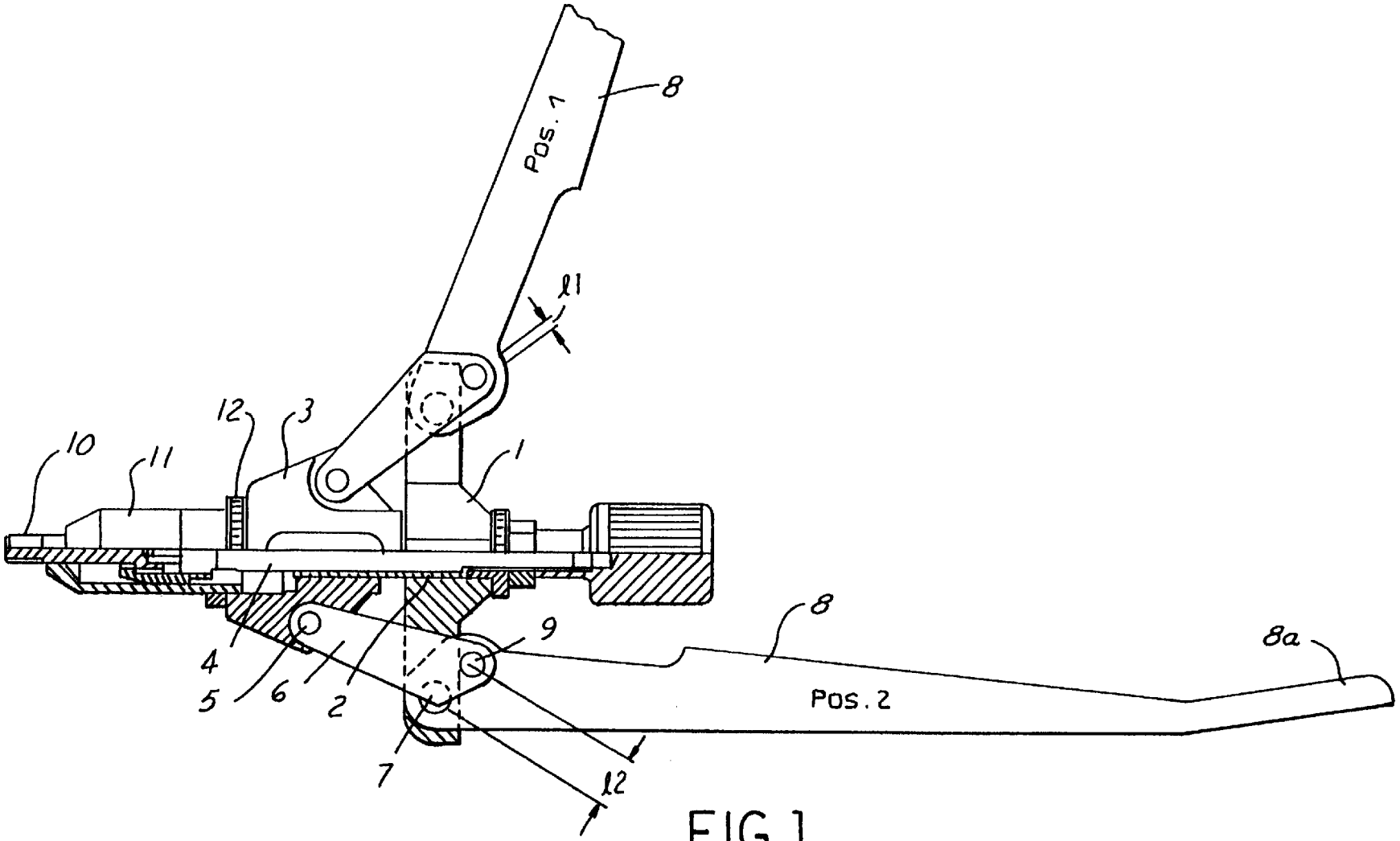
FIG. 1 is a plan view of a blind-rivet setting tool in two positions, partly in longitudinal section, of a first embodiment of the invention.

FIG. 1 shows a hand-riveter, that is a blind-rivet setting tool to be driven by hand. The main components of the apparatus comprise a bearing block 1, a bearing bush 2, a housing member 3, two pairs of levers 6 and 8, a rod 4 and a screw-threaded bolt or drift 10 and an anvil 11. Block 1 and bush 2 are fixed to one another e.g. by means of screwing.

Housing member 3 is slidably supported on bush 2 and carries anvil 11 fixed by a nut 12. Rod 4 is ratably supported in bush 2 and carries bolt or drift 10 as recognized in the art.

The pair of levers 8 are hand driven and both can take an initial position (pos.1) as shown in the upper half of FIG. 1, and an end position (pos.2) as shown in the lower half of FIG. 1. Each lever 8 has a distal end formed as a hand-hold 8*a* and a proximal end 8*b* formed with bearing holes. Hand lever 8 is pivotally connected to bearing block 1 through a first pin-bearing structure 7 at it's proximal end 8*b*. Each lever 6 is a connecting link between hand lever 8 and housing member 3 and includes a forward end which is journaled in the housing member 3 with a second pin-bearing structure 5, and a rear-end which is connected to the hand lever 8 by a third pin-bearing structure 9. The pin-bearing structures 5, 7 and 9 are arranged at the corners of a triangle forming an obtuse angle at the pin-bearing structure 7. Members 5 through 9 form a toggle lever arrangement showing a varying transmission ratio. Hand lever 8 has two arms, namely a long arm between hand-hold 8*a* and pin 7, and a short arm between pins 7 and 9. In the toggle lever arrangement 5 through 9, the effective length l of the short lever arm between pins 7 and 9 depends on the shape of the triangle 5,7,9. In the initial position of the lever 8 indicted as Pos.1 the effective length of the short lever arm is indicated at l1 and in the end position(pos.2) of the hand lever 8, the effective length of the short lever arm is indicated l2. The transmission ratio of the toggle lever arrangement, in the working stroke between pos.1 and pos.2 and in the return stroke between pos.1 and pos.2, is the ratio between the total length of the lever arm 8 and the respective effective length l of the short lever arm.

When lever 8 is moved somewhat from Pos.1 towards Pos.2, pins 5, 7 and 9 will be on a straight line, i.e the leverage 6, 8 takes a dead centre position where the effective length l of the short lever arm is at a minimum. This means that the transfer of force from hand lever 8 to linking lever 6 is at a maximum. When hand lever 8 is further moved towards pos.2, the effective length l of short lever arm will increase and therefore the transmission ratio of the force will decrease. In the return stroke the change in the transmission ratio is reversed.

Figure 2:
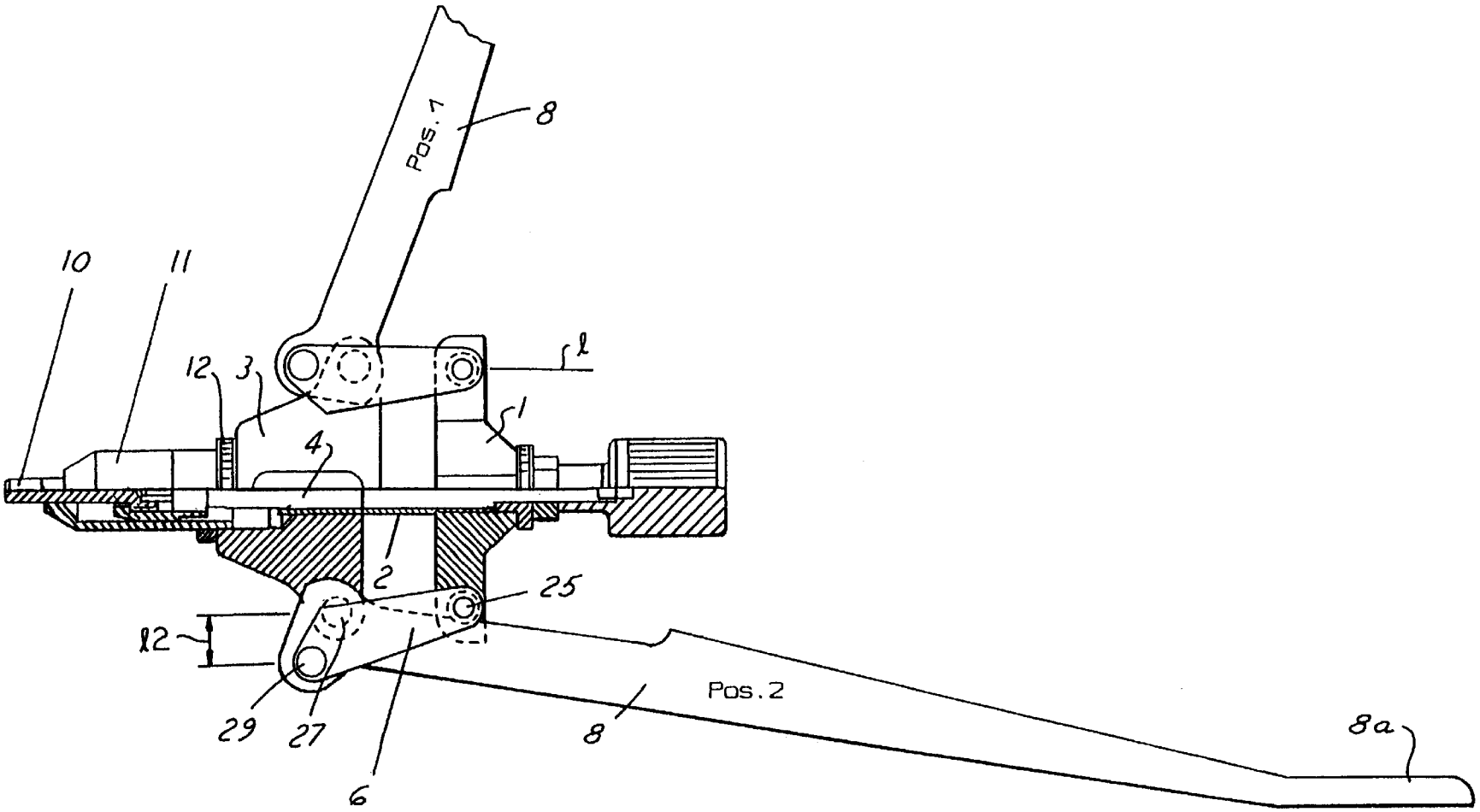
FIG. 2 is a plan view of a blind-rivet setting tool in two positions, partly in longitudinal section, of a second embodiment of the invention.

Referring to FIG. 2, a second embodiment of the invention is shown where corresponding members with the first embodiment have the same reference numbers. The difference is in the toggle lever arrangement. Hand lever 8 is pivotally supported by a pin-bearing structure 27 in housing 3, and connecting lever 6 is pivotally supported by pin-bearing structure 25 in bearing block 1. Levers 6 and 8 are coupled by a pin-bearing structure 29 with one another. With lever pair 8 in Pos.1, the toggle lever arrangement takes the dead centre position where the pin-bearing structures 25, 27 and 29 are on a line or nearly on a line so that any movement of hand lever pair 8 towards pos.2 will produce a small travel length transmission ratio for relative movement between drift 10 and anvil 11, and a large force transmission ratio for the hand force finally acting onto the work piece. The force transmission ratio decreases as hand lever pair 8 moves from Pos.1 to Pos.2.

Figure 3:
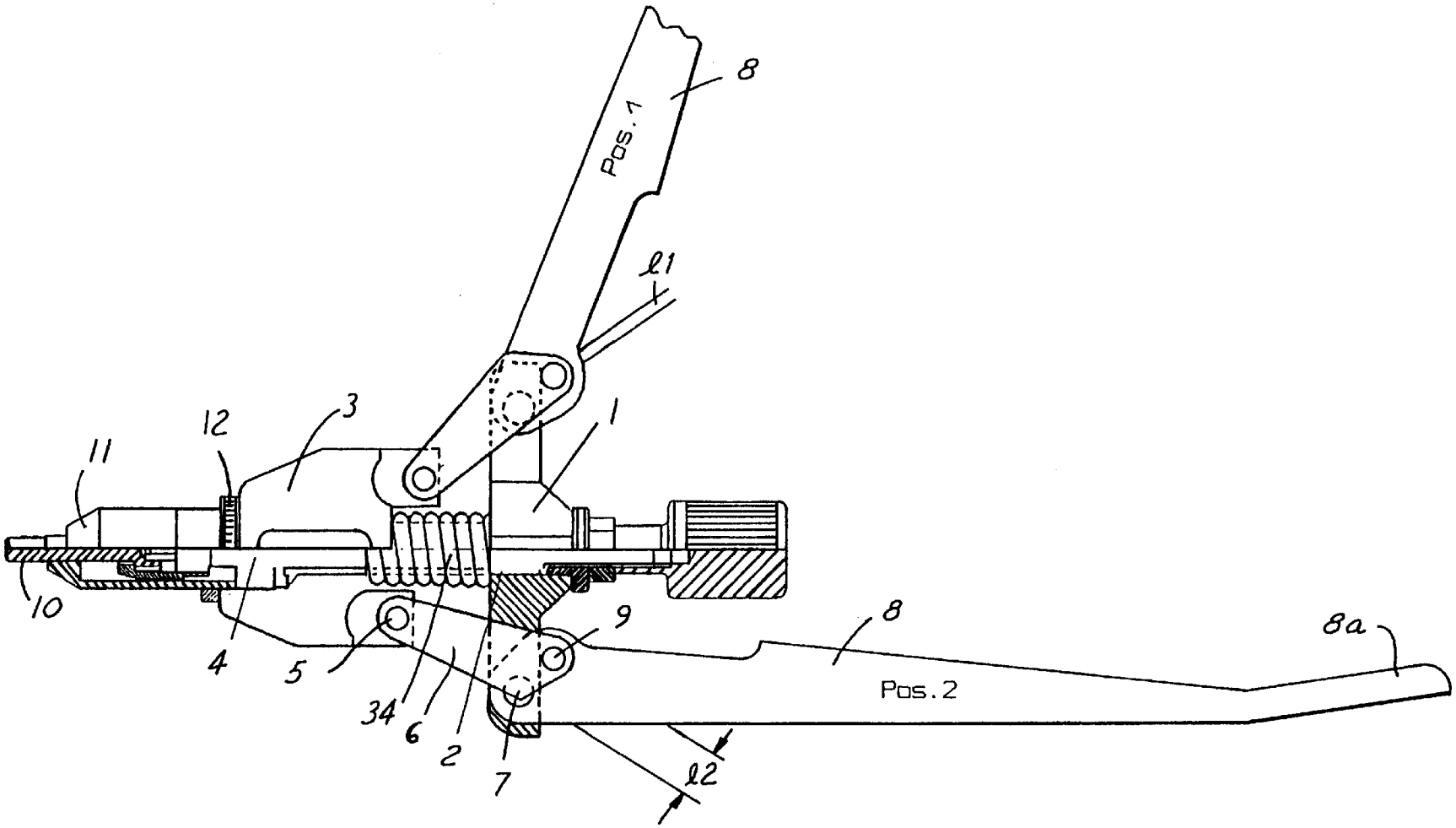
FIG. 3 is a plan view of a blind-rivet setting tool in two positions, partly in longitudinal section, of a third embodiment of the invention.

FIG. 3 shows a variation to the FIG. 1 embodiment. A spring 34 is arranged between bearing block 1 and housing 3. Spring 34 is guided on bearing bush 2. In the initial position of the hand lever pair 8, spring 34 is held in it's compressed condition since pin-bearing structure 9 is arranged above dead centre. Pin 9 has a projecting length in direction to the bearing block 1 so that in the end position of lever pair 8, the projecting end of pin 9 will abut with the rear surface of bearing block 1. When lever pair 8 is moved somewhat from pos.1 into the dead centre position with pins 5,7,9 aligned, spring 34 is a little further compressed yet when lever pair 8 is moved beyond the dead centre position towards pos.2, spring 34 will expand and supply an additional force to the tool assisting the force which the operator implys on the tool. Please note that the spring force 34 will decrease as the spring expands.

Figure 4:
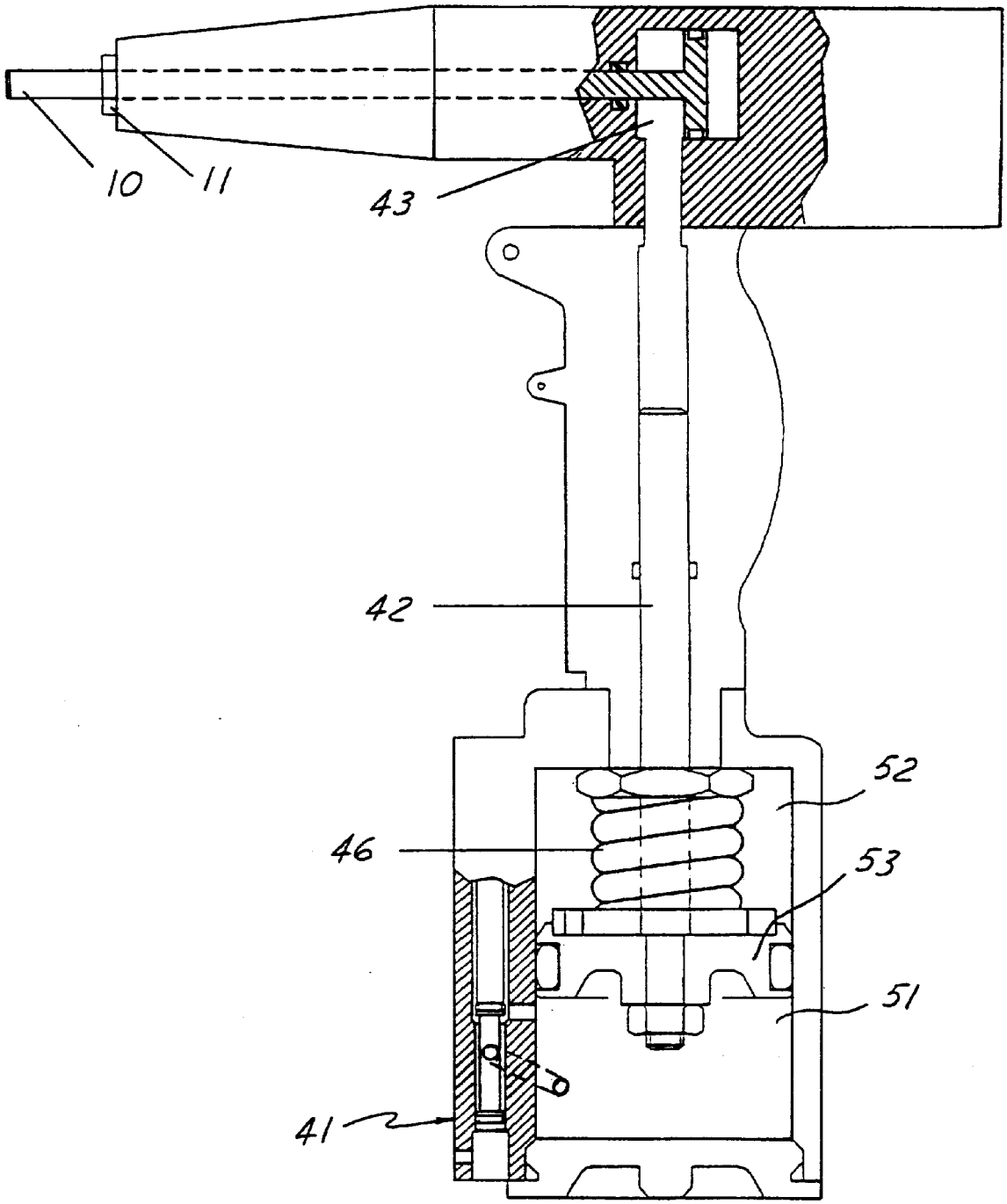
FIG. 4 is a schematic view of a blind rivet setting tool, partly in longitudinal section, of a fourth embodiment of the invention.

FIG. 4 shows a blind-rivet setting tool having a hydropneumatic drive device, including a pneumatic cylinder 41, a hydraulic piston 42 and a hydraulic cylinder 43. The pneumatic cylinder 41 includes a spring 46 which is to be compressed when compressed air is fed into the cylinder. The pneumatic cylinder drives the hydraulic piston 42 so as to produce fluid pressure for the hydraulic cylinder 43 which will drive bolt or drift 10 accordingly (to the right-hand side in FIG. 4).

Since pneumatic cylinder 41 is actuated against the force of the spring 46, which is increasing, the remaining force for driving the hydraulic piston 42 is decreasing. Therefore, the relative force between drift 10 and anvil 11 is decreasing during the travel of the piston of hydraulic cylinder 43.

Figure 5:
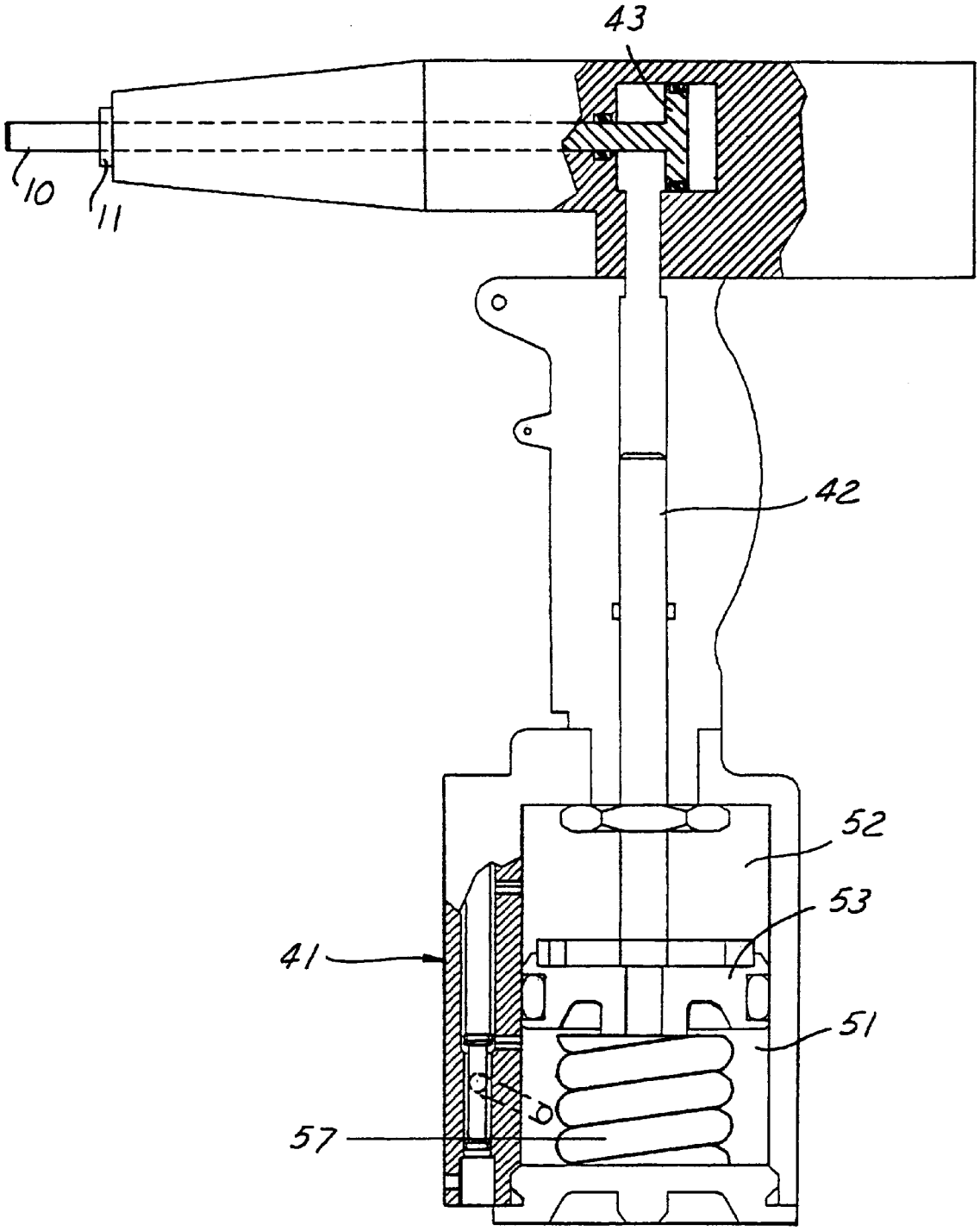
FIG. 5 is a schematic view of a blind-rivet setting tool, partly in longitudinal section, of a fifth embodiment of the invention.
Figure 6A:
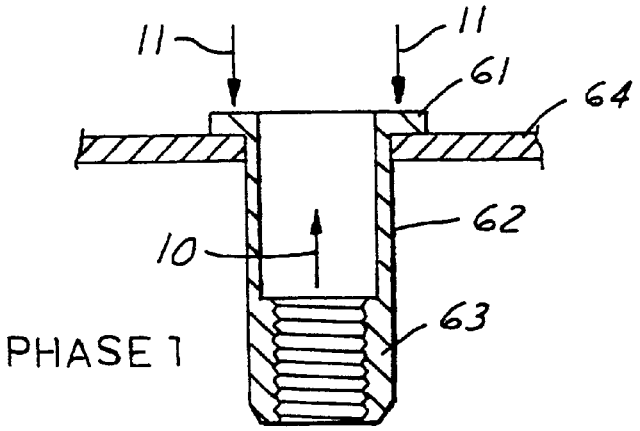
FIGS. 6A, 6B, 6C and 6D show the setting of a blind-rivet in four phases.
Figure 6B:
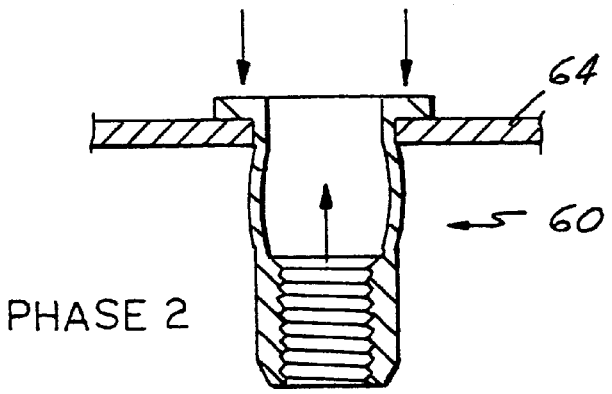
Figure 6C:
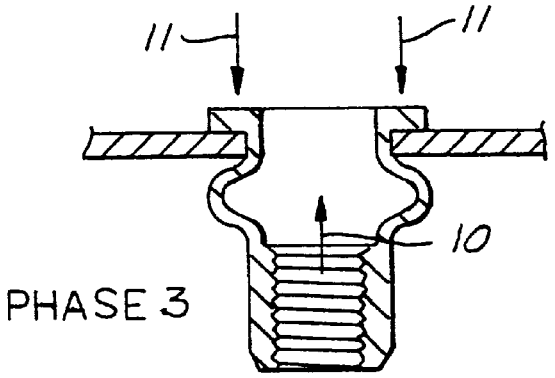
Figure 6D:
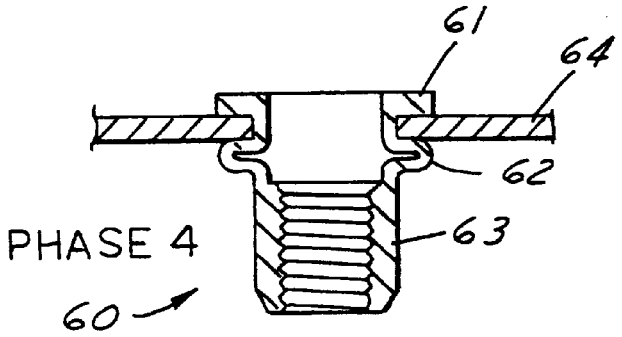

FIG. 5 shows a further embodiment which is a variation to the FIG. 4 embodiment of the invention. For corresponding members, corresponding reference numbers are used. Pneumatic cylinder 41 has two chambers 51 and 52 and a double-acting piston 53. A spring 57 is arranged in chamber 51. In the forward stroke of the pneumatic cylinder 41, piston 53 is acted upon by the constant force of air pressure and by the decreasing force of spring 57. This will produce a decreasing force at the hydraulic piston 42 and the hydraulic cylinder 43 and therefore also between drift 10 and anvil 11. In the return stroke of the device, spring 57 will be compressed.

FIGS. 6A–6D show the setting of a blind-rivet 60. Such a blind-rivet has a head 61, a thin walled sleeve portion 62 and a nut 63. The blind-rivet 60 is inserted in an opening of a wall or sheet 64. The drift 10 of the riveter is screwed into the nut 63 when the riveter is in it's initial position. The head 61 of the rivet is held down by the anvil 11 and when the riveter is operated, the drift 10 moves the nut 63 towards the anvil 11. If the force developed is large enough, the thin walled sleeve 62 will bulge. The force required for bulging is highest between phase 1 and phase 2. When bulging goes on into phase 3 and 4, the force necessary for bulging decreases. In phase 4, development of force should be shut-off.

The rivet setting tool of invention affords this requirements. When the drift 10 begins to move from it's initial position into the end position, the force delivered by the riveter is high and decreases at the end of the stroke. The operator of the pair of hand levers 8 meets a favourable force transmission ratio for the force exerted on the lever pair. At the end of the stroke, the transmission ratio is such that the force on the drift and nut is lowest so that the danger of damaging the threads of the nuts 63 by exerting too high a force is avoided.

It is to be understood that the invention may be embodied in other specific forms without departing from the central characteristics thereof. For example, the spring may be constructed so as to assist riveting in the initial phase of riveting whereas in the end phase of riveting the spring may inhibit further riveting. In that respect, the spring may act as a pressure spring and a tension spring depending upon which phase the device is in. In that respect, the spring may be loaded in the return stroke of the riveter. When riveting, the spring assists the drawing or pulling force of the drift as described, and restrains the drawing or pulling force of the drift at the end of it's stroke.

Instead of coil springs also flexible materials can be used. It is also possible to reduce air pressure supplied to the riveter at the end of the working stroke. For the same purpose, it is also possible to use damping means such as oil brakes, dash pots and frictional devices. The present examples and embodiments therefore, are to be considered in all respects as illustrative and not restrictive and the invention is not to be limited to the details given therein.

What is claimed is:

1. A rivet setting tool comprising;

means for engaging a rivet having a thin walled sleeve portion and a nut with an internal thread, said engaging means having a threaded portion to threadingly engage said nut of the rivet;

housing means including an anvil for supporting said rivet when the rivet setting tool is in operation;

means for slidably supporting said engaging means relative to said housing means;

means for driving said engaging means relative to said housing and anvil so as to make working strokes and return strokes respectively, said driving means including a pneumatic cylinder having a double acting piston, said piston dividing said pneumatic cylinder into first and second chambers, said first chamber being impinged by pressure supplied thereto during the working stroke and said second chamber being impinged by pressure during the return stroke, said first chamber also including a spring which is biased during said return stroke and develops a decreasing force during said working stroke.

* * * * *